US011333166B2

(12) United States Patent
Yamamoto et al.

(10) Patent No.: US 11,333,166 B2
(45) Date of Patent: May 17, 2022

(54) PROPELLER FAN AND REFRIGERATION CYCLE APPARATUS

(71) Applicant: Mitsubishi Electric Corporation, Tokyo (JP)

(72) Inventors: Katsuyuki Yamamoto, Tokyo (JP); Seiji Nakashima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 41 days.

(21) Appl. No.: 16/496,544

(22) PCT Filed: May 25, 2017

(86) PCT No.: PCT/JP2017/019545
§ 371 (c)(1),
(2) Date: Sep. 23, 2019

(87) PCT Pub. No.: WO2018/216164
PCT Pub. Date: Nov. 29, 2018

(65) Prior Publication Data

US 2020/0325909 A1 Oct. 15, 2020

(51) Int. Cl.
*F04D 29/38* (2006.01)
*F04D 29/32* (2006.01)

(52) U.S. Cl.
CPC ..... *F04D 29/384* (2013.01); *F04D 29/325* (2013.01); *F04D 29/324* (2013.01);
(Continued)

(58) Field of Classification Search
CPC .... F04D 29/384; F04D 29/325; F04D 29/324; F04D 29/667; F05B 2240/301; F05B 2240/304
See application file for complete search history.

(56) References Cited

U.S. PATENT DOCUMENTS

2014/0086754 A1 3/2014 Seiji et al.
2014/0341748 A1* 11/2014 Kojima ..... F04D 19/002 416/234

(Continued)

FOREIGN PATENT DOCUMENTS

CN 107795516 A 3/2018
EP 3 290 715 A1 3/2018

(Continued)

OTHER PUBLICATIONS

Extended European Search Report dated May 14, 2020 issued in corresponding EP application No. 17911234.7.

(Continued)

*Primary Examiner* — Sabbir Hasan
(74) *Attorney, Agent, or Firm* — Posz Law Group, PLC

(57) ABSTRACT

A propeller fan includes a rotary shaft portion that rotates around an axial center and a plurality of blades disposed around an outer circumferential portion of the rotary shaft portion. Each of the plurality of blades has at least one recessed portion that opens at a trailing edge of the blade. The at least one recessed portion has a first side that is close to an inner circumference of the blade. The first side stretches from the trailing edge toward a leading edge of the blade, and is bent toward an outer circumference of the blade.

7 Claims, 8 Drawing Sheets

(52) U.S. Cl.
CPC .. *F05B 2240/301* (2013.01); *F05D 2240/303* (2013.01); *F05D 2240/304* (2013.01)

(56) References Cited

U.S. PATENT DOCUMENTS

| | | | | |
|---|---|---|---|---|
| 2016/0298886 | A1* | 10/2016 | Ishibashi | F28F 1/022 |
| 2018/0066521 | A1* | 3/2018 | Sawada | F04D 29/384 |

FOREIGN PATENT DOCUMENTS

| | | | |
|---|---|---|---|
| JP | 2003-206894 | A | 7/2003 |
| JP | 4132826 | B2 | 8/2008 |
| JP | 4467952 | B2 | 5/2010 |
| JP | 2014-105600 | A | 6/2014 |
| JP | 2016-183643 | A | 10/2016 |

OTHER PUBLICATIONS

Office Action dated Jun. 23, 2020 issued in corresponding JP application No. 2019-519900 (and English translation).
International Search Report of the International Searching Authority dated Aug. 15, 2017 for the corresponding international application No. PCT/JP2017/019545 (and English translation).
Office Action dated Jul. 3, 2020 issued in corresponding CN patent application No. 201780089891.4 (and English translation).
Office Action dated Oct. 13, 2020 issued in corresponding JP patent application No. 2019-519900 (and English translation).
Office Action dated Mar. 3, 2021 issued in corresponding CN patent application No. 201780089891.4 (and English translation).

* cited by examiner

PROPELLER FAN AND REFRIGERATION CYCLE APPARATUS

CROSS REFERENCE TO RELATED APPLICATION

This application is a U.S. national stage application of International Application No. PCT/JP2017/019545, filed on May 25, 2017, the contents of which are incorporated herein by reference.

TECHNICAL FIELD

The present invention relates to a propeller fan used in a refrigeration cycle apparatus such as an air-conditioning apparatus and a ventilation apparatus and to a refrigeration cycle apparatus including the propeller fan.

BACKGROUND

Propeller fans (axial-flow air-sending devices) have been expected to reduce noise. To satisfy such an expectation, various propeller fans with blades shaped to reduce noise have been proposed.

For example, Patent Literature 1 discloses a propeller fan "with a hub attached around a fan rotary shaft and equipped with two blades, each of the blades having a blade trailing edge portion from which an airflow flows out during the rotation of the fan, and that has a trailing edge recessed portion having a substantially arc shape, V-shape, or polygonal shape and recessed in a direction opposite to the direction of the airflow, one of the blades being disposed to be substantially point-symmetric about the other one of the blades in a range of 180 degrees ±5 degrees around the fan rotary shaft, and the blades being disposed to have solidity $\sigma=L/T$ ranging from 0.3 to 0.55 within a range of 0.75 Rm to 1.25 Rm when a mathematical formula $Rm=(D1-D2)/2$ is satisfied, wherein L represents the length of a blade chord line, T represents an inter-blade pitch, D1 represents the outer diameter size of each of the blades, and D2 represents the outer diameter size of the hub."

Patent Literature

Patent Literature 1: Japanese Patent No. 4467952

The abovementioned technique described in Patent Literature 1 sets the solidity $\sigma$ to the range of 0.3 to 0.55 to reduce noise. With the technique described in Patent Literature 1, however, a side of the recessed portion that is close to an inner circumference of the blade has a straight line shape, thereby increasing a flow leaking from a pressure surface to a suction surface. The technique therefore has an issue of insufficient reduction in noise.

SUMMARY

The present invention has been made to address the above-described issue, and aims to provide a propeller fan adopting a blade shape that reduces the flow leaking from the pressure surface to the suction surface to reduce noise and a refrigeration cycle apparatus including the propeller fan.

A propeller fan according to one embodiment of the present invention includes a rotary shaft portion that rotates around an axial center and a plurality of blades disposed around an outer circumferential portion of the rotary shaft portion. Each of the plurality of blades has at least one recessed portion that opens at a trailing edge of the blade. The at least one recessed portion has a first side that is close to an inner circumference of the blade. The first side stretches from the trailing edge toward a leading edge of the blade, and is bent toward an outer circumference of the blade.

A refrigeration cycle apparatus according to another embodiment of the present invention includes a refrigerant circuit in which a compressor, a first heat exchanger, an expansion device, and a second heat exchanger are connected by pipes. The above-described propeller fan is mounted in a cooling unit together with the first heat exchanger to supply air to the first heat exchanger.

The propeller fan according to one embodiment of the present invention includes the blades each with the trailing edge having the recessed portion with the first side that is close to the inner circumference of the blade, stretches from the trailing edge toward the leading edge, and is bent toward the outer circumference of the corresponding one of the blades. Consequently, the airflow along a side of the recessed portion that is close to the inner circumference flows along the curved shape of the first side, making it possible to reduce a leakage vortex, and thus to reduce input and noise.

The refrigeration cycle apparatus according to another embodiment of the present invention has the above-described propeller fan included in the cooling unit together with the first heat exchanger, and thus reduces noise.

DETAILED DESCRIPTION

Embodiments 1 to 6 of the present invention will be described below with reference to the drawings. In the following drawings including FIG. 1, the dimensional relationships between components may be different from actual ones. Further, in the following drawings including FIG. 1, components denoted with identical reference signs are identical or equivalent to each other, which applies to the entire text of the specification. Further, the forms of component elements described throughout the text of the specification are basically illustrative, and forms of component elements are not limited to these described ones.

Embodiment 1

Figure 1:
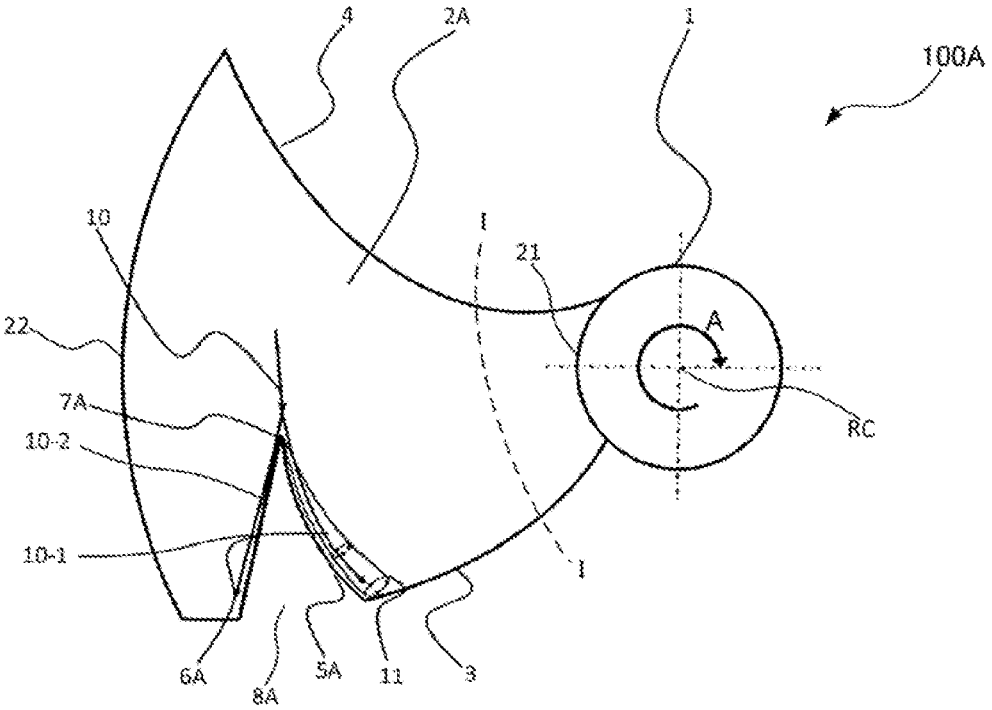
FIG. 1 is a schematic diagram of a propeller fan according to Embodiment 1 of the present invention viewed from an upstream side.
Figure 2:
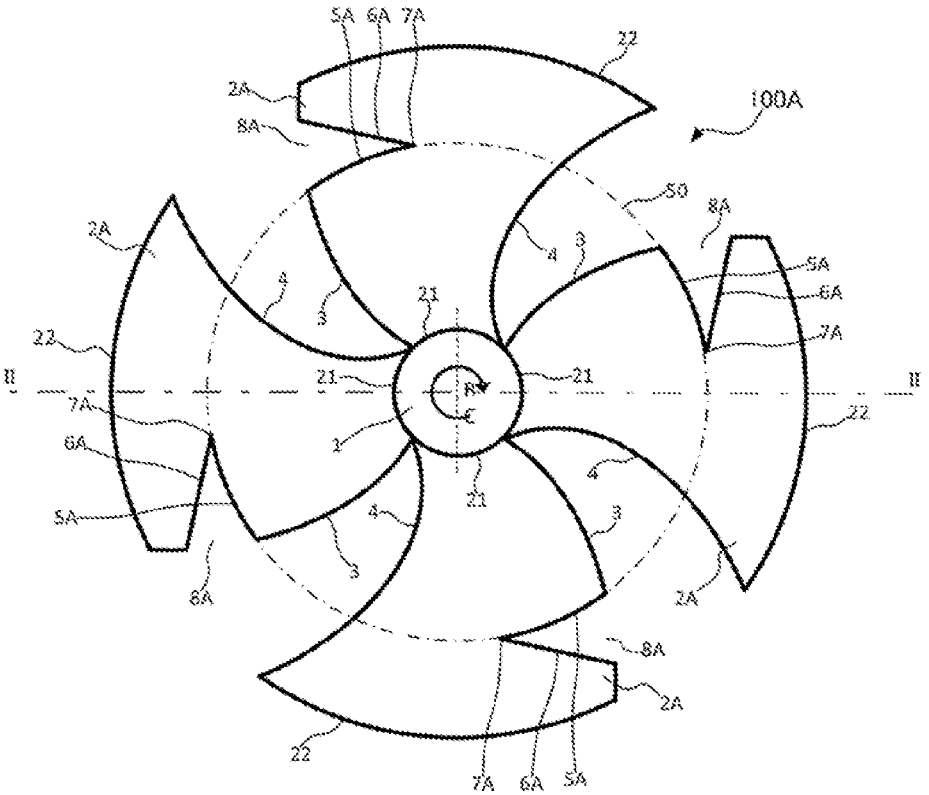
FIG. 2 is a schematic diagram for illustrating recessed portions of the propeller fan according to Embodiment 1 of the present invention.
Figure 3:
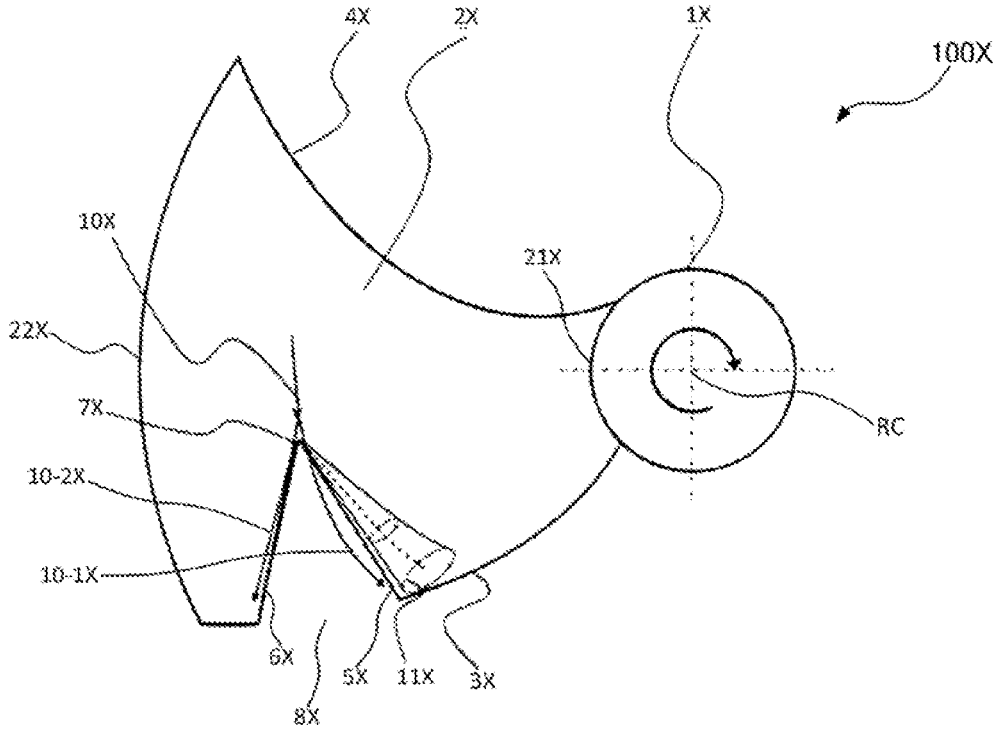
FIG. 3 Related Art
FIG. 3 is a schematic diagram of a propeller fan in the related art viewed from the upstream side.

FIG. 1 is a schematic diagram of a propeller fan 100A according to Embodiment 1 of the present invention viewed from an upstream side. FIG. 2 is a schematic diagram for illustrating recessed portions 8A of the propeller fan 100A. FIG. 3 is a schematic diagram of a propeller fan (hereinafter referred to as the propeller fan 100X) in the related art viewed from the upstream side. The propeller fan 100A will be described with reference to FIGS. 1 and 2. In the description of the propeller fan 100A, the propeller fan 100A will be compared, as appropriate, with the propeller fan 100X in FIG. 3. In FIG. 3, each of components of the propeller fan 100X corresponding to components of the propeller fan 100A is denoted with "X" at the end of the reference sign of the component to distinguish the component from the corresponding one of the propeller fan 100A.

FIG. 1 illustrates only one blade 2A of the propeller fan 100A. That is, although the propeller fan 100A includes a plurality of blades 2A, only one blade 2A of the plurality of blades 2A is illustrated for convenience. Further, FIG. 2 illustrates four blades 2A of the propeller fan 100A. The number of blades 2A, however, is not particularly limited. Further, the recessed portion is provided to each blade irrespective of the number of blades 2A, and effects of employing the propeller fan 100A according to Embodiment 1 of the present invention are obtained for each blade.

The propeller fan 100A includes a boss 1 that rotates around an axial center RC and the plurality of blades 2A disposed around an outer circumferential portion of the boss 1. Each of the blades 2A is surrounded by an inner circumferential end 21, an outer circumferential end 22, a leading edge 4, and a trailing edge 3. Further, the recessed portion 8A that opens at a part of the trailing edge 3 is formed in the trailing edge 3 of the blade 2A.

The boss 1 corresponds to a "rotary shaft portion" of the present invention.

The recessed portion 8A will be described in detail.

The recessed portion 8A has sides. One of the sides is on an inner circumference side of the blade 2A. The one of sides is, in other words, close to an inner circumference of the blade 2A, and stretches from the trailing edge 3 toward the leading edge 4 is defined as a first side 5A. Further, the other one of the sides of the recessed portion 8A is on an outer circumference side of the blade 2A. The other one of the sides is, in other words, close to an outer circumference of the blade 2A, and stretches from the trailing edge 3 toward the leading edge 4 and toward the inner circumference of the blade 2A (toward the inner circumferential end 21) is defined as a second side 6A. As the first side 5A stretches toward the leading edge 4 and toward the outer circumference of the blade 2A and the second side 6A stretches toward the leading edge 4 and toward the inner circumference of the blade 2A, both the first side 5A and the second side 6A terminate at an intersection to which the first side 5A and the second side 6A stretch from the trailing edge 3 toward the leading edge 4. This intersection is defined as a vertex 7A. Further, as illustrated in FIGS. 1 and 2, the first side 5A is formed in a curved shape projecting and bent toward the outer circumference of the blade 2A.

That is, in a top view of the propeller fan 100A viewed from the upstream side in the axial direction, the recessed portion 8A is defined as an open area partly by the first side 5A and the second side 6A that serve as boundaries of the recessed portion 8A. Further, in the top view, the recessed portion 8A is formed in a substantially triangular shape with the first side 5A bent toward the outer circumference of the blade 2A, that is, with the first side 5A forming a curved shape projecting toward the outer circumference of the blade 2A.

The recessed portion 8A will be further specifically described.

As illustrated in FIG. 2, for example, the propeller fan 100A includes four blades 2A. The recessed portion 8A that opens at a part of the trailing edge 3 is formed in each of the blades 2A. In the top view of the propeller fan 100A viewed from the upstream side, the first side 5A of the recessed portion 8A may be on the circumference of a concentric circle 50 that is concentric with the boss 1, for example. That is, in the top view of the propeller fan 100A viewed from the upstream side, the first side 5A forms an arc that corresponds to a part of the concentric circle 50, which is concentric with the boss 1. It is possible to determine the shape of the first side 5A in the above-described manner, and thus to simplify the determination of the shape of the first side 5A.

As illustrated in FIG. 3, the propeller fan 100X includes a boss 1X that rotates around the axial center RC and a plurality of blades 2X disposed around an outer circumferential portion of the boss 1X. Each of the blades 2X is surrounded by an inner circumferential end 21X, an outer circumferential end 22X, a leading edge 4X, and a trailing edge 3X. Further, a recessed portion 8X is formed in the trailing edge 3X of the blade 2X.

The recessed portion 8X will be described in detail.

The recessed portion 8X has sides and one of the sides that is close to an inner circumference of the blade 2X and stretches from the trailing edge 3X toward the leading edge 4X and toward an outer circumference of the blade 2X (toward the outer circumferential end 22X) is defined as a first side 5X. Further, the other one of the sides of the recessed portion 8X that is close to the outer circumference of the blade 2X and stretches from the trailing edge 3X toward the leading edge 4X and toward the inner circumference of the blade 2X (toward the inner circumferential end 21X) is defined as a second side 6X. As the first side 5X stretches toward the leading edge 4X and toward the outer circumference of the blade 2X and the second side 6X stretches toward the leading edge 4X and toward the inner circumference of the blade 2X, both the first side 5X and the second side 6X terminate at an intersection to which the first side 5X and the second side 6X stretch from the trailing edge 3X toward the leading edge 4X. This intersection is defined as a vertex 7X.

That is, in a top view of the propeller fan 100X viewed from the upstream side in the axial direction, the recessed portion 8X is defined as an open area partly by the first side 5X and the second side 6X that serve as boundaries of the recessed portion 8X. Further, in the top view, the recessed portion 8X is formed in a substantially triangular shape with the first side 5X and the second side 6X each formed in a straight line shape. Alternatively, in the top view, the recessed portion 8X is formed in a substantially triangular shape with the first side 5X formed in an arc shape recessed in a direction opposite to the direction of an airflow.

An operation of the propeller fan 100A will be briefly described.

A motor (illustration of the motor is omitted) attached to the boss 1 is driven to rotate, thereby rotating the three-dimensional solid blade 2A illustrated in FIGS. 1 and 2 around the axial center RC in the direction of arrow A together with the boss 1. With the rotation of the blade 2A, an airflow (blown airflow) is generated from the front of the drawing sheet toward the rear of the drawing sheet. An upstream surface of the blade 2A form is a suction surface, and a downstream surface of the blade 2A form is a pressure surface.

Effects of the propeller fan 100A will be described in comparison with those of the propeller fan 100X.

With the recessed portion 8X, the propeller fan 100X is capable of diverting an airflow passing the vicinity of the recessed portion 8X (arrow 10X illustrated in FIG. 3) toward both the inner circumference and the outer circumference of the blade 2X from the vertex 7X. An airflow close to the inner circumference is represented by arrow 10-1X, and an airflow close to the outer circumference is represented by arrow 10-2X.

Further, the synergy effect with the centrifugal force of the propeller fan 100X allows the airflow (arrow 10-2X) close to the outer circumference to move toward the outer circumference, on which the work in one rotation is large, thereby reducing input. However, the airflow (arrow 10-1X) close to the inner circumference fails to flow along the straight line shape of the side of the recessed portion 8X that is close to the inner circumference and separates from the straight line. Consequently, the separated flow moves from the pressure surface toward the suction surface, thereby increasing a leakage vortex 11X. The increase of the leakage vortex 11X results in an increase in loss and thus deterioration of input. Further, interference of the leakage vortex 11X with an object placed downstream generates large noise.

With the recessed portion 8A, the propeller fan 100A is capable of diverting a flow passing the vicinity of the recessed portion 8A (arrow 10 illustrated in FIG. 1) toward both the inner circumference and the outer circumference of the blade 2A from the vertex 7A. An airflow close to the inner circumference is represented by arrow 10-1, and an airflow close to the outer circumference is represented by arrow 10-2.

Further, the synergy effect with the centrifugal force of the propeller fan 100A allows the airflow (arrow 10-2) close to the outer circumference to move toward the outer circumference, on which the work in one rotation is large, thereby reducing input. In addition, the first side 5A of the recessed portion 8A is formed in a curved shape bent toward the outer circumference. Consequently, a flow on the pressure surface flows along the curved shape bent toward the outer circumference, making it possible to suppress the separation of the airflow (arrow 10-1) close to the inner circumference. It is therefore possible to reduce a leakage vortex 11 in the airflow (arrow 10-1) close to the inner circumference. The propeller fan 100A is therefore capable of reducing the leakage vortex 11 with the recessed portion 8A, and thus reduces input and noise.

Figure 4:
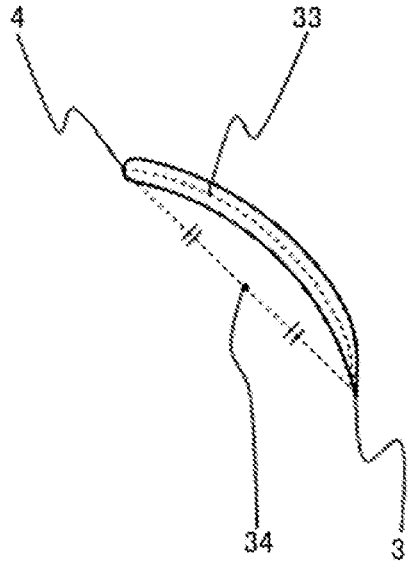
FIG. 4 is a cross-sectional view of the propeller fan in FIG. 1 taken along line I-I.
Figure 5:
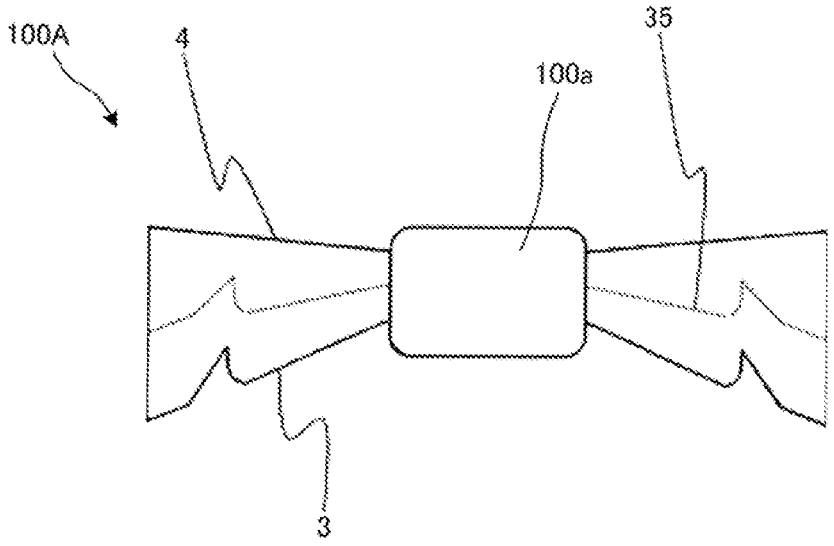
FIG. 5 is a cross-sectional view of the propeller fan in FIG. 2 taken along line II-II.
Figure 6:
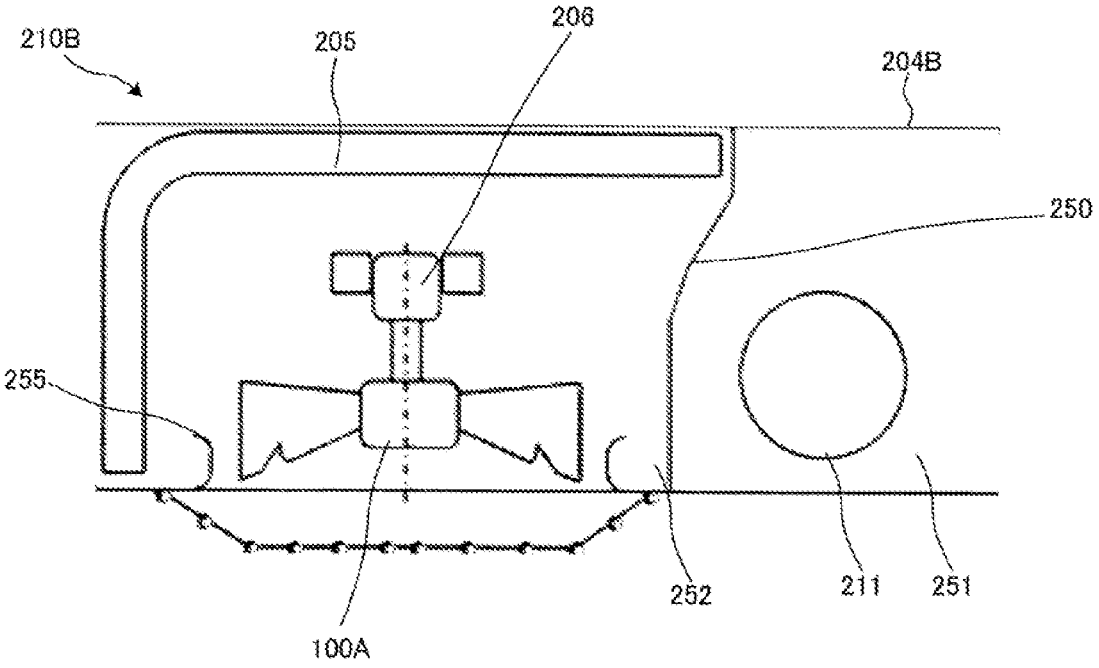
FIG. 6 is a schematic configuration diagram schematically illustrating an example of the configuration of a cooling unit having the propeller fan according to Embodiment 1 of the present invention mounted in the cooling unit.

FIG. 4 is a cross-sectional view of the propeller fan 100A in FIG. 1 taken along line I-I. FIG. 5 is a cross-sectional view of the propeller fan 100A in FIG. 2 taken along line II-II. FIG. 6 is a schematic configuration diagram schematically illustrating an example of the configuration of a cooling unit 2108 having the propeller fan 100A mounted in the cooling unit 2108. The effects of the propeller fan 100A will further be described with reference to FIGS. 4 to 6. The cooling unit 2108 illustrated in FIG. 6 will be described in detail in Embodiment 6.

FIG. 4 illustrates a camber line 33 of the blade 2A in a cylindrical cross section around the axial center RC and a blade chord midpoint 34 corresponding to the midpoint of a straight line connecting the leading edge 4 and the trailing edge 3 on the camber line 33. FIG. 5 illustrates a blade chord center line 35 that is a curved line obtained by connecting blade chord midpoints 34, one of which is illustrated in FIG. 4, from the inner circumferential end 21 to the outer circumferential end 22.

The leakage vortex 11 contributes to the magnitude of the pressure difference between the pressure surface and the suction surface. The leakage vortex 11 increases with an increase in the pressure difference. In the propeller fan 100A with the blade chord center line 35 projecting downstream in an area along the radial direction excluding the recessed portion 8A, as illustrated in FIGS. 4 and 5, a large increase in pressure tends to be obtained on the pressure surface during the rotation. Consequently, the pressure difference between the pressure surface and the suction surface is increased, thereby increasing the leakage vortex 11. To avoid such an increase of the leakage vortex 11, the propeller fan 100A has the recessed portion 8A to be able to reduce the leakage vortex 11, and thus is effective.

As illustrated in FIG. 6, the cooling unit 2108 is used as a heat source-side unit (outdoor unit), for example. The cooling unit 210B includes a housing 204B forming an exterior of the cooling unit 2108. The housing 204B accommodates a separator 250 to divide an interior of the housing 204B into an air-sending device chamber 252 in which the propeller fan 100A is installed and a mechanical chamber 251 in which components such as a compressor 211 are installed. Further, a motor 206 for driving the propeller fan 100A and a first heat exchanger 205 are installed in the air-sending device chamber 252. Further, a bell mouth 255 is installed around the propeller fan 100A.

As illustrated in FIG. 6, when the bell mouth 255 and the propeller fan 100A are disposed to increase an overlapping area of the bell mouth 255 and the propeller fan 100A and the propeller fan 100A is viewed from a lateral side, a large increase in pressure is obtained on the pressure surface in the overlapping area of the bell mouth 255 and the propeller fan 100A. Consequently, the leakage vortex 11 is increased. Even when the bell mouth 255 and the propeller fan 100A are disposed to increase the overlapping area of the bell mouth 255 and the propeller fan 100A, however, the propeller fan 100A has the recessed portion 8A. Consequently, the propeller fan 100A is capable of reducing the leakage vortex 11, and thus is effective.

Parameters such as the number of recessed portions 8A, the respective lengths of the first side 5A and the second side 6A forming each of the recessed portions 8A, and the angle formed by the first side 5A and the second side 6A at the vertex 7A are not particularly limited, and may be specified as appropriate.

Further, although the shape of the first side 5A has been described with reference to FIG. 2, parameters such as the curvature of the first side 5A are not limited to those in FIG. 2.

Further, although the first side 5A stretching from the trailing edge 3 toward the leading edge 4 has been described as an example, the first side 5A may stretch from the trailing edge 3 toward the leading edge 4 and toward the outer circumference of the blade 2A (toward the outer circumferential end 22) depending on the shape of the first side 5A.

Further, the second side 6A may be a straight line or a curved line.

In Embodiment 1, the propeller fan 100A including the boss 1 as an example of the rotary shaft portion has been described. The propeller fan 100A, however, may be an integrated blade propeller fan. The integrated blade propeller fan includes a rotary shaft portion (rotation center) connected to a rotary shaft of a drive source such as a motor and a plurality of blades disposed on the outer circumference portion of the rotary shaft portion, and is formed in such a manner that adjacent blades of the plurality of blades are connected to each other at a leading edge portion and a trailing edge portion. That is, in the integrated blade propeller fan, the adjacent blades are connected to each other not via a boss portion but as a continuous surface. In this case, the rotary shaft portion serving as the rotation center corresponds to the "rotary shaft portion" of the present invention. Forming a propeller fan as the integrated blade propeller fan is similarly applicable to Embodiments 2 to 6 described below.

Embodiment 2

Figure 7:
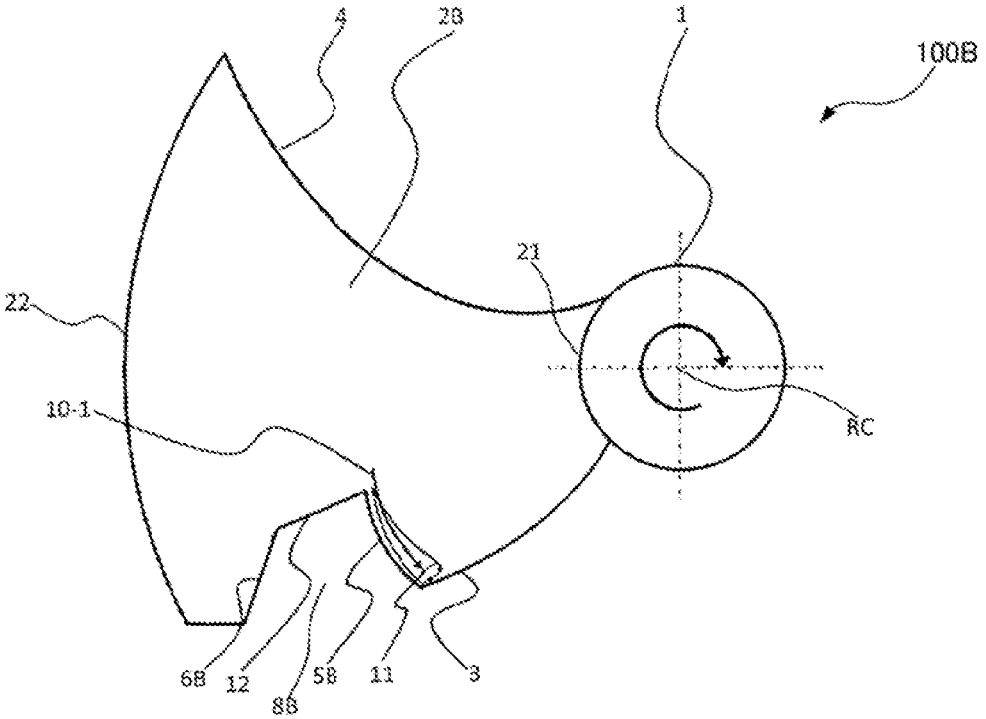
FIG. 7 is a schematic diagram of a propeller fan according to Embodiment 2 of the present invention viewed from the upstream side.

FIG. 7 is a schematic diagram of a propeller fan 100B according to Embodiment 2 of the present invention viewed from the upstream side. The propeller fan 100B will be described with reference to FIG. 7.

In Embodiment 2, description will focus on differences from Embodiment 1. The same parts as those of Embodiment 1 are denoted with the same reference signs, and description of the parts will be omitted.

In Embodiment 2, a blade 2B of the propeller fan 100B is different from the blade 2A of the propeller fan 100A according to Embodiment 1.

FIG. 7 illustrates only one blade 2B of the propeller fan 100B. That is, although the propeller fan 100B includes a plurality of blades 2B, only one blade 2B of the plurality of blades 2B is illustrated for convenience. Further, the number of blades 2B is not particularly limited. Further, the recessed portion is provided to each blade irrespective of the number of blades 2B, and effects of employing the propeller fan 100B according to Embodiment 2 of the present invention are obtained for each blade.

The propeller fan 100B includes the boss 1 that rotates around the axial center RC and the plurality of blades 2B disposed around the outer circumferential portion of the boss 1. Each of the blades 2B is surrounded by the inner circumferential end 21, the outer circumferential end 22, the leading edge 4, and the trailing edge 3. Further, a recessed portion 8B that opens at a part of the trailing edge 3 is formed in the trailing edge 3 of the blade 2B.

The recessed portion 8B will be described in detail.

The recessed portion 8B has sides and one of the sides that is close to an inner circumference of the blade 2B and stretches from the trailing edge 3 toward the leading edge 4 is defined as a first side 5B. Further, another one of the sides of the recessed portion 8B that is close to the outer circumference of the blade 2B and stretches from the trailing edge 3 toward the leading edge 4 and toward the inner circumference of the blade 2B (toward the inner circumferential end 21) is defined as a second side 6B. Further, still another one of the sides of the recessed portion 8B that is close to the leading edge 4 is defined as a third side 12. The third side 12 is a side connecting a side end of the first side 5B that is close to the leading edge and a side end of the second side 6B that is close to the leading edge. Further, as illustrated in FIG. 7, the first side 5B is formed in a curved shape bent toward the outer circumference of the blade 2B.

That is, in a top view of the propeller fan 100B viewed from the upstream side in the axial direction, the recessed portion 8B is defined as an open area partly by the first side 5B, the second side 6B, and the third side 12 that serve as boundaries of the recessed portion 8B. Further, in the top view, the recessed portion 8B is formed in a substantially quadrangular shape (parallelogram or trapezoid shape, for example) with the first side 5B bent toward the outer circumference of the blade 2B, that is, with the first side 5B forming a curved shape projecting toward the outer circumference of the blade 2B.

Effects of the propeller fan 100B will be described.

For example, when the trailing edge of a propeller fan is formed with a recessed portion having a substantially parallelogram shape in a top view of the propeller fan and having a side that is close to an inner circumference of a blade and is a straight line, the load on the side that is close to the inner circumference is reduced, relatively increasing the load on a side that is close to the outer circumference of the blade and has the work of the largest amount in one rotation. Thereby, the input is reduced. With such a recessed portion, however, the airflow close to the inner circumference fails to flow along the straight line shape of the side that is close to the inner circumference and separates from the straight line shape of the side that is close to the inner circumference, similarly as in the recessed portion 8X illustrated in FIG. 3. With such a recessed portion, consequently, the propeller fan is unable to efficiently reduce input and noise similarly to the propeller fan 100X in the related art described above.

By contrast, in the propeller fan 100B, the first side 5B of the recessed portion 8B is formed in the curved shape bent toward the outer circumference of the blade 2B. With the recessed portion 8B, the airflow on the pressure surface flows along the curved shape bent toward the outer circumference of the blade 2B, making it possible to suppress the separation of the airflow (arrow 10-1) in the recessed portion 8B that is close to the inner circumference of the blade 2B. It is therefore possible to reduce the leakage vortex 11 in the airflow (arrow 10-1) close to the inner circumference. The propeller fan 100B is therefore capable of reducing the leakage vortex 11 with the recessed portion 8B, and thus reduces input and noise similarly to the propeller fan 100A according to Embodiment 1.

Parameters such as the number of recessed portions 8B, the respective lengths of the first side 5B, the second side 6B, and the third side 12 forming each of the recessed portions 8B, the angle formed by the first side 5B and the third side 12, and the angle formed by the second side 6B and the third side 12 are not particularly limited, and may be specified as appropriate.

Further, although the shape of the first side 5B may be determined as in FIG. 2 similarly to that of the first side 5A, parameters such as the curvature of the first side 5B are not particularly limited.

Further, although the first side 5B stretching from the trailing edge 3 toward the leading edge 4 has been described as an example, the first side 5B may stretch from the trailing edge 3 toward the leading edge 4 and toward the outer circumference of the blade 2B (toward the outer circumferential end 22) depending on the shape of the first side 5B.

Further, the second side 6B may be a straight line or a curved line.

Embodiment 3

Figure 8:
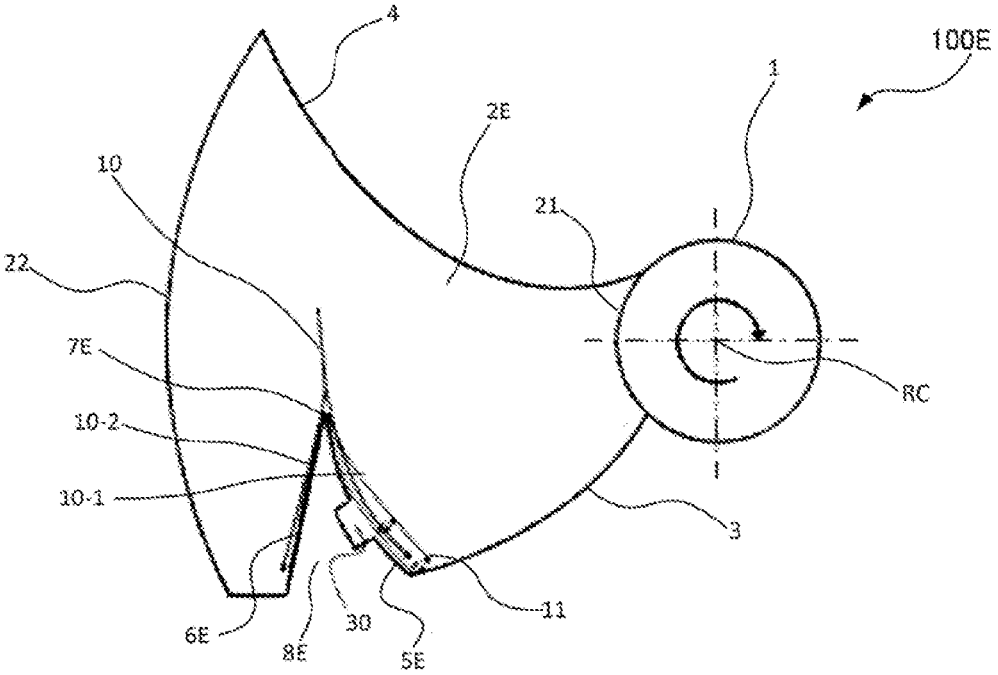
FIG. 8 is a schematic diagram of a propeller fan according to Embodiment 3 of the present invention viewed from the upstream side.
Figure 9:
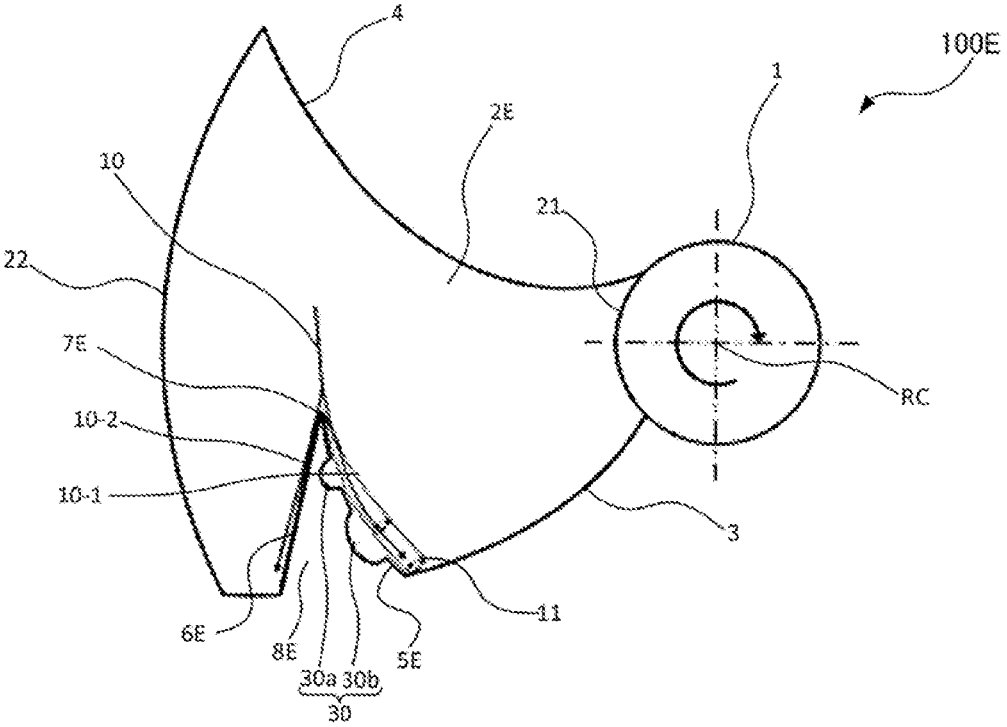
FIG. 9 is a schematic diagram of a propeller fan according to Embodiment 3 of the present invention viewed from the upstream side.

Each of FIGS. 8 and 9 is a schematic diagram of a propeller fan 100E according to Embodiment 3 of the present invention viewed from the upstream side. The propeller fan 100E will be described with reference to FIGS. 8 and 9.

In Embodiment 3, description will focus on differences from Embodiments 1 and 2. The same parts as those of Embodiments 1 and 2 are denoted with the same reference signs, and description of the parts will be omitted.

In Embodiment 3, a blade 2E of the propeller fan 100E is different from the blade 2A of the propeller fan 100A according to Embodiment 1.

FIG. 8 illustrates only one blade 2E of the propeller fan 100E. That is, although the propeller fan 100E includes a plurality of blades 2E, only one blade 2E of the plurality of blades 2E is illustrated for convenience. Further, the number of blades 2E is not particularly limited. Further, the recessed portion is provided to each blade irrespective of the number of blades 2E, and effects of employing the propeller fan 100E according to Embodiment 3 of the present invention are obtained for each blade.

The propeller fan 100E includes the boss 1 that rotates around the axial center RC and the plurality of blades 2E disposed around the outer circumferential portion of the boss 1. Each of the blades 2E is surrounded by the inner circumferential end 21, the outer circumferential end 22, the leading edge 4, and the trailing edge 3. Further, a recessed portion 8E that opens at a part of the trailing edge 3 is formed in the trailing edge 3 of the blade 2E. Further, a projecting portion (first projecting portion) 30 is formed on one of sides of the recessed portion 8E that is close to an inner circumference of the blade 2E.

The recessed portion 8E and the projecting portion 30 will be described in detail.

The recessed portion 8E has the sides and the one of the sides that is close to the inner circumference of the blade 2E and stretches from the trailing edge 3 toward the leading edge 4 is defined as a first side 5E. Further, the other one of the sides of the recessed portion 8E that is close to an outer circumference of the blade 2E and stretches from the trailing edge 3 toward the leading edge 4 and toward the inner circumference of the blade 2E (toward the inner circumferential end 21) is defined as a second side 6E. As the first side 5E stretches toward the leading edge 4 and toward the outer circumference of the blade 2E and the second side 6E stretches toward the leading edge 4 and toward the inner circumference of the blade 2E, both the first side 5E and the second side 6E terminate at an intersection to which the first side 5E and the second side 6E stretch from the trailing edge 3 toward the leading edge 4. This intersection is defined as a vertex 7E. Further, the first side 5E is formed in a curved shape bent toward the outer circumference of the blade 2E, as illustrated in FIG. 8.

That is, in a top view of the propeller fan 100E viewed from the upstream side in the axial direction, the recessed portion 8E is defined as an open area partly by the first side 5E and the second side 6E that serve as boundaries of the recessed portion 8E. Further, in the top view, the recessed portion 8E is formed in a substantially triangular shape with the first side 5E bent toward the outer circumference of the blade 2E, that is, with the first side 5E forming a curved shape projecting toward the outer circumference of the blade 2E. The recessed portion 8E is basically the same as the recessed portion 8A described in Embodiment 1.

As illustrated in FIG. 8, the projecting portion 30 is formed as a part of the first side 5E of the recessed portion 8E projecting toward the outer circumferential end 22. Further, in the top view of the propeller fan 100E viewed from the upstream side in the axial direction, the projecting portion 30 is formed in a rectangular shape. FIG. 8 illustrates an example in which the propeller fan 100E has one projecting portion 30.

Effects of the propeller fan 100E will be described.

The propeller fan 100E has the recessed portion 8E with the first side 5E having a curved shape bent toward the outer circumference of the blade 2E, and the first side 5E of the recessed portion 8E is formed with the projecting portion 30. On the first side 5E, consequently, an area is formed that has a certain width between the first side 5E and the leakage vortex 11 generated from the vertex 7E along the arc shape of the first side 5E. This area reduces the contribution to the generation of the leakage vortex 11.

The propeller fan 100E is therefore capable of reducing the leakage vortex 11 flowing downstream from the propeller fan 100E, and thus reduces noise.

Parameters such as the number of recessed portions 8E, the respective lengths of the first side 5E and the second side 6E forming each of the recessed portions 8E, the angle formed by the first side 5E and the second side 6E at the vertex 7E, the number, size, and shape of projecting portions 30, and the curvature of the fourth side 13-3 are not particularly limited, and may be specified as appropriate.

As illustrated in FIG. 9, for example, the projecting portion 30 may include, as a plurality of projecting portions 30, a leading edge-side projecting portion 30*a* and a trailing edge-side projecting portion 30*b* each having a curved outer circumference. When the projecting portion 30 provided to each of the first sides 5E includes a plurality of projecting portions 30, the plurality of projecting portions 30 may have the same shape and size, or may have different shapes and sizes.

Further, the shape of the first side 5E may be determined as in FIG. 2 similarly to that of the first side 5A. However, parameters such as the curvature of the first side 5E are not particularly limited.

Further, the projecting portion 30 may be combined with the recessed portion 8B described in Embodiment 2.

Further, although the first side 5E stretching from the trailing edge 3 toward the leading edge 4 has been described as an example, the first side 5E may stretch from the trailing edge 3 toward the leading edge 4 and toward the outer circumference of the blade 2E (toward the outer circumferential end 22) depending on the shape of the first side 5E.

Further, the second side 6E may be a straight line or a curved line.

Embodiment 4

Figure 10:
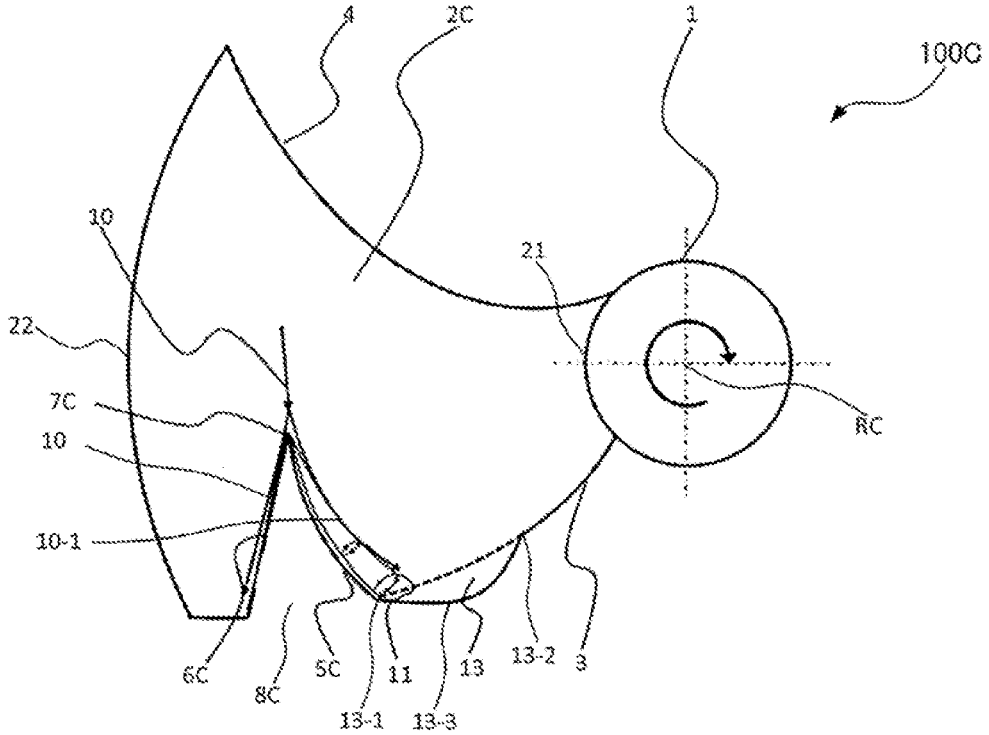
FIG. 10 is a schematic diagram of a propeller fan according to Embodiment 4 of the present invention viewed from the upstream side.

FIG. 10 is a schematic diagram of a propeller fan 100C according to Embodiment 4 of the present invention viewed from the upstream side. The propeller fan 100C will be described with reference to FIG. 10.

In Embodiment 4, description will focus on differences from Embodiments 1 to 3. The same parts as those of Embodiments 1 to 3 are denoted with the same reference signs, and description of the parts will be omitted.

In Embodiment 4, a blade 2C of the propeller fan 100C is different from the blade 2A of the propeller fan 100A according to Embodiment 1.

FIG. 10 illustrates only one blade 2C of the propeller fan 100C. That is, although the propeller fan 100C includes a plurality of blades 2C, only one blade 2C of the plurality of blades 2C is illustrated for convenience. Further, the number of blades 2C is not particularly limited. Further, the recessed portion is provided to each blade irrespective of the number of blades 2C, and effects of employing the propeller fan 100C according to Embodiment 4 of the present invention are obtained for each blade.

The propeller fan 100C includes the boss 1 that rotates around the axial center RC and the plurality of blades 2C disposed around the outer circumferential portion of the boss 1. Each of the blades 2C is surrounded by the inner circumferential end 21, the outer circumferential end 22, the leading edge 4, and the trailing edge 3. Further, a recessed portion 8C that opens at a part of the trailing edge 3 and a projecting portion (second projecting portion) 13 are formed in the trailing edge 3 of the blade 2C.

The recessed portion 8C and the projecting portion 13 will be described in detail.

The recessed portion 8C has sides and one of the sides that is close to an inner circumference of the blade 2C and stretches from the trailing edge 3 toward the leading edge 4 is defined as a first side 5C. Further, the other one of the sides of the recessed portion 8C that is close to an outer circumference of the blade 2C and stretches from the trailing edge 3 toward the leading edge 4 and toward the inner circumference of the blade 2C (toward the inner circumferential end 21) is defined as a second side 6C. As the first side 5C stretches toward the leading edge 4 and toward the outer circumference of the blade 2C and the second side 6C stretches toward the leading edge 4 and toward the inner circumference of the blade 2C, both the first side 5C and the second side 6C terminate at an intersection to which the first side 5C and the second side 6C stretch from the trailing edge 3 toward the leading edge 4. This intersection is defined as a vertex 7C. Further, as illustrated in FIG. 10, the first side 5C is formed in a curved shape bent toward the outer circumference of the blade 2C.

That is, in a top view of the propeller fan 100C viewed from the upstream side in the axial direction, the recessed portion 8C is defined as an open area partly by the first side 5C and the second side 6C that serve as boundaries of the recessed portion 8C. Further, in the top view, the recessed portion 8C is formed in a substantially triangular shape with the first side 5C bent toward the outer circumference of the blade 2C, that is, with the first side 5C forming a curved shape projecting toward the outer circumference of the blade 2C. The recessed portion 8C is basically the same as the recessed portion 8A described in Embodiment 1.

One side end of the projecting portion 13 that is close to the outer circumferential end 22 is defined as a side end 13-1, and the other side end of the projecting portion 13 that is close to the inner circumferential end 21 is defined as a side end 13-2.

As illustrated in FIG. 10, the projecting portion 13 is formed in such a manner that, in a portion of the trailing edge 3 that is closer to the inner circumference (inner circumferential end 21) than is the recessed portion 8C, the side end 13-1 coincides with a side end of the first side 5C of the recessed portion 8C that terminates at the trailing edge 3, the side end 13-2 terminates at a portion of the trailing edge 3 located closer to the inner circumference than is the side end 13-1, and a side connecting the side ends 13-1 and 13-2 along the outer circumference of the projecting portion 13 (a fourth side 13-3) projects downstream.

Effects of the propeller fan 100C will be described.

For example, when a part of the trailing edge of a propeller fan is formed with a projecting portion projecting downstream, the work of the area formed with the projecting portion is increased. Consequently, the velocity of an airflow passing the projecting portion is increased to be relatively higher than that of a surrounding flow. With the increase in velocity of the airflow passing the projecting portion, an effect of drawing in the surrounding flow is obtained.

Meanwhile, when the trailing edge of a propeller fan is formed with a recessed portion having a substantially triangular or parallelogram shape in a top view of the propeller fan and having a side that is close to an inner circumference of a blade and is a straight line and a projecting portion is formed on a portion of the trailing edge that is closer to the inner circumference than is the recessed portion to reduce the leakage on the side of the recessed portion that is close to the inner circumference, an airflow close to the inner circumference fails to flow along the straight line shape of the side that is close to the inner circumference and separates from the straight line shape of the side that is close to the inner circumference. Even with the projecting portion, the effect of drawing in the airflow close to the inner circumference is not sufficiently obtained.

By contrast, the propeller fan 100C has the recessed portion 8C with the first side 5C having a curved shape bent toward the outer circumference of the blade 2C, and the projecting portion 13 is formed on the portion of the trailing edge 3 that is closer to the inner circumference of the blade 2C than is the recessed portion 8C. Consequently, the airflow along the recessed portion 8C that is close to the inner circumference flows along the curved shape bent toward the outer circumference, making it easier to obtain the draw-in effect of the projecting portion 13. It is thereby possible to further suppress the generation of the leakage vortex 11. Consequently, in addition to the effects of the propeller fan 100A according to Embodiment 1, the propeller fan 100C is capable of further reducing the leakage vortex 11 with the projecting portion 13, and thus further reduces input and noise.

Parameters such as the number of recessed portions 8C, the respective lengths of the first side 5C and the second side 6C forming each of the recessed portions 8C, the angle formed by the first side 5C and the second side 6C at the vertex 7C, the size and shape of the projecting portion 13, and the curvature of the fourth side 13-3 are not particularly limited, and may be specified as appropriate.

Further, the shape of the first side 5C may be determined as in FIG. 2 similarly to that of the first side 5A. However, parameters such as the curvature of the first side 5C are not particularly limited.

Further, the projecting portion 13 may be combined with at least one of the recessed portion 8B described in Embodiment 2 and the recessed portion 8E described in Embodiment 3.

Further, although the first side 5C stretching from the trailing edge 3 toward the leading edge 4 has been described as an example, the first side 5C may stretch from the trailing edge 3 toward the leading edge 4 and toward the outer circumference of the blade 2C (toward the outer circumferential end 22) depending on the shape of the first side 5C.

Further, the second side 6C may be a straight line or a curved line.

Embodiment 5

Figure 11:
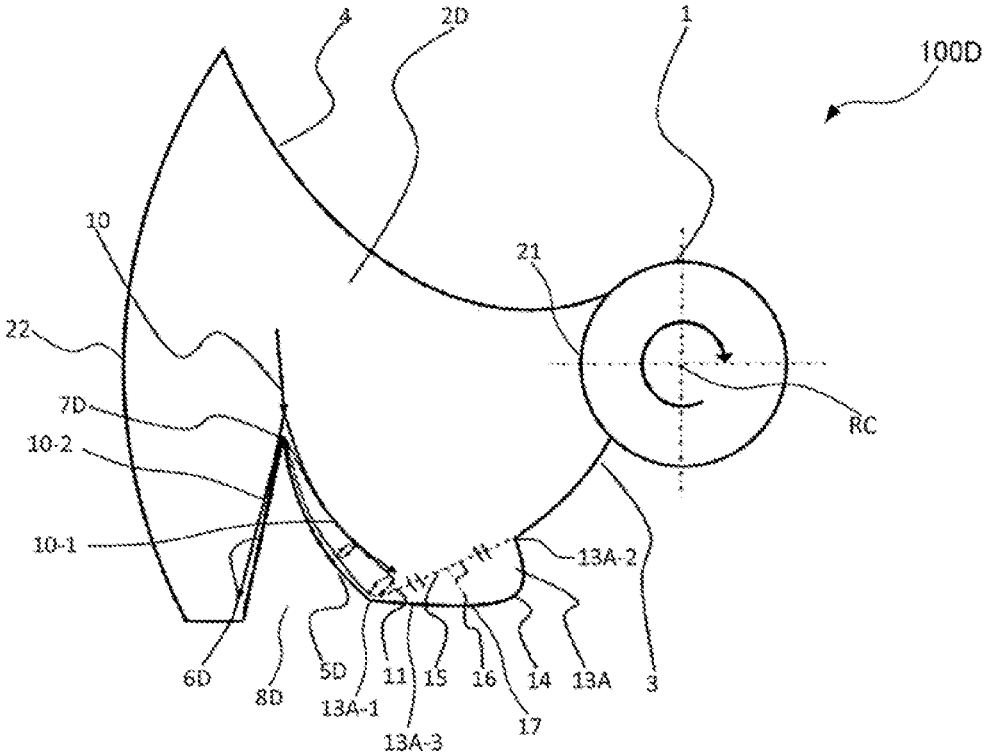
FIG. 11 is a schematic diagram of a propeller fan according to Embodiment 5 of the present invention viewed from the upstream side.

FIG. 11 is a schematic diagram of a propeller fan 100D according to Embodiment 5 of the present invention viewed from the upstream side. The propeller fan 100D will be described with reference to FIG. 11.

In Embodiment 5, description will focus on differences from Embodiments 1 to 4. The same parts as those of Embodiments 1 to 4 are denoted with the same reference signs, and description of the parts will be omitted.

In Embodiment 5, a blade 2D of the propeller fan 100D is different from the blade 2A of the propeller fan 100A according to Embodiment 1.

FIG. 11 illustrates only one blade 2D of the propeller fan 100D. That is, although the propeller fan 100D includes a plurality of blades 2D, only one blade 2D of the plurality of blades 2D is illustrated for convenience. Further, the number of blades 2D is not particularly limited. Further, the recessed portion is provided to each blade irrespective of the number of blades 2D, and effects of employing the propeller fan 100D according to Embodiment 5 of the present invention are obtained for each blade.

The propeller fan 100D includes the boss 1 that rotates around the axial center RC and the plurality of blades 2D disposed around the outer circumferential portion of the boss 1. Each of the blades 2D is surrounded by the inner circumferential end 21, the outer circumferential end 22, the leading edge 4, and the trailing edge 3. Further, a recessed portion 8D that opens at a part of the trailing edge 3 and a projecting portion 13A are formed in the trailing edge 3 of the blade 2D.

The recessed portion 8D and the projecting portion 13A will be described in detail.

The recessed portion 8D has sides and one of the sides that is close to an inner circumference of the blade 2D and stretches from the trailing edge 3 toward the leading edge 4 is defined as a first side 5D. Further, the other one of the sides of the recessed portion 8D that is close to an outer circumference of the blade 2D and stretches from the trailing edge 3 toward the leading edge 4 and toward the inner circumference of the blade 2D (toward the inner circumferential end 21) is defined as a second side 6D. As the first side 5D stretches toward the leading edge 4 and toward the outer circumference of the blade 2D and the second side 6D stretches toward the leading edge 4 and toward the inner circumference of the blade 2D, both the first side 5D and the second side 6D terminate at an intersection to which the first side 5D and the second side 6D stretch from the trailing edge 3 toward the leading edge 4. This intersection is defined as a vertex 7D. Further, as illustrated in FIG. 11, the first side 5D is formed in a curved shape bent toward the outer circumference of the blade 2D.

That is, in a top view of the propeller fan 100D viewed from the upstream side in the axial direction, the recessed portion 8D is defined as an open area partly by the first side 5D and the second side 6D that serve as boundaries of the recessed portion 8D. Further, in the top view, the recessed portion 8D is formed in a substantially triangular shape with the first side 5D bent toward the outer circumference of the blade 2D, that is, with the first side 5D forming a curved shape projecting toward the outer circumference of the blade 2D. The recessed portion 8D is basically the same as the recessed portion 8A described in Embodiment 1.

One side end of the projecting portion 13A that is close to the outer circumferential end 22 is defined as a side end 13A-1, and the other side end of the projecting portion 13A that is close to the inner circumferential end 21 is defined as a side end 13A-2.

As illustrated in FIG. 11, the projecting portion 13A is formed in such a manner that, in a portion that is closer to the inner circumference (inner circumferential end 21) of the trailing edge 3 than is the recessed portion 8D, the side end 13A-1 coincides with a side end of the first side 5D of the recessed portion 8D that terminates at the trailing edge 3, the side end 13A-2 terminates at a portion of the trailing edge 3 located closer to the inner circumference than is the side end 13A-1, and a side connecting the side ends 13A-1 and 13A-2 along the outer circumference of the projecting portion 13A (a fourth side 13A-3) projects downstream.

Further, a straight line connecting the side ends 13A-1 and 13A-2 is defined as a first virtual line 15. A line perpendicularly extending from the midpoint of the first virtual line 15 to the fourth side 13A-3 is defined as a second virtual line 16. The intersection of the fourth side 13A-3 and the second virtual line 16 is defined as an intersection point 17.

Further, the projecting portion 13A is formed in such a manner that a maximum projection point 14 on the fourth side 13A-3 of the projecting portion 13A is positioned closer to the inner circumference than is the intersection point 17.

Effects of the propeller fan 100D will be described.

Similarly to the projecting portion 13 of Embodiment 4, the projecting portion 13A is configured to draw in the surrounding flow. In addition, the airflow passing the projecting portion 13A gathers at a point of the projecting portion 13A projecting most downstream, that is, the maximum projection point 14. Consequently, with the maximum projection point 14 located to be closer to the inner circumference of the blade 2D than is the intersection point 17, it is possible to obtain an effect of drawing the airflow along the recessed portion 8D that is close to the inner circumference further toward the inner circumference. That is, in addition to the effects of the propeller fan 100C according to Embodiment 4, the propeller fan 100D is capable of further reducing the leakage vortex 11 with the projecting portion 13A, and thus further reduces input and noise.

Parameters such as the number of recessed portions 8D, the respective lengths of the first side 5D and the second side 6D forming each of the recessed portions 8D, the angle formed by the first side 5D and the second side 6D at the vertex 7D, the size and shape of the projecting portion 13A, and the curvature of the fourth side 13A-3 are not particularly limited, and may be specified as appropriate.

Further, the shape of the first side 5D may be determined as in FIG. 2 similarly to that of the first side 5A. However, parameters such as the curvature of the first side 5D are not particularly limited.

Further, the projecting portion 13A may be combined with the recessed portion 8B described in Embodiment 2.

Further, although the first side 5D stretching from the trailing edge 3 toward the leading edge 4 has been described as an example, the first side 5D may stretch from the trailing edge 3 toward the leading edge 4 and toward the outer circumference of the blade 2D (toward the outer circumferential end 22) depending on the shape of the first side 5D.

Further, the second side 6D may be a straight line or a curved line.

Embodiment 6

Figure 12:
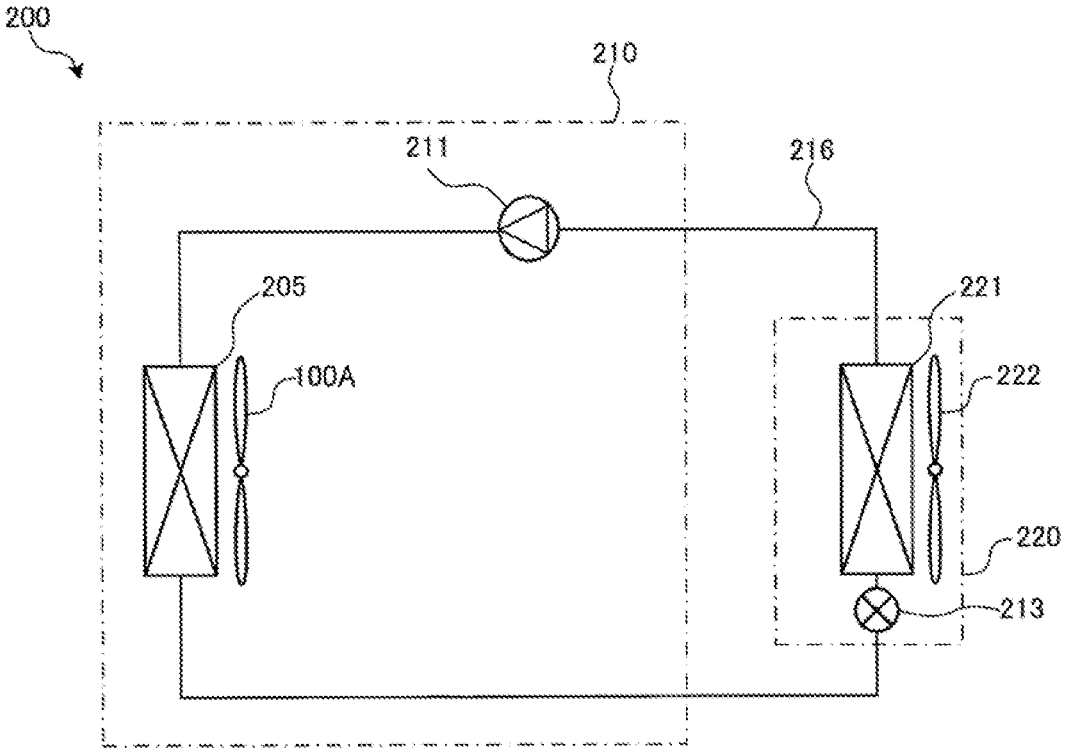
FIG. 12 is a circuit configuration diagram schematically illustrating a configuration of a refrigerant circuit of a refrigeration cycle apparatus according to Embodiment 6 of the present invention.
Figure 13:
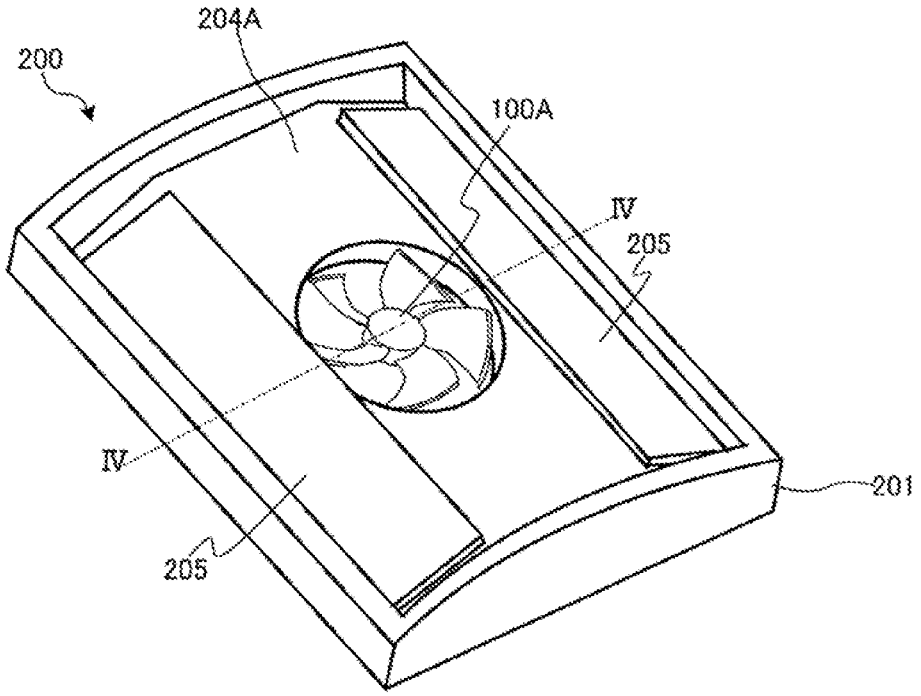
FIG. 13 is a schematic perspective view schematically illustrating an example of the configuration of a cooling unit forming a part of the refrigeration cycle apparatus according to Embodiment 6 of the present invention.
Figure 14:
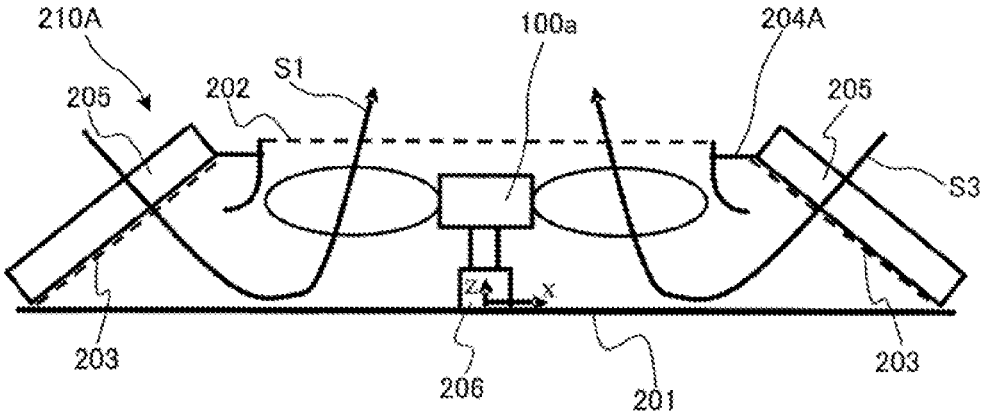
FIG. 14 is a cross-sectional view of the cooling unit in FIG. 13 taken along line IV-IV.
Figure 15:
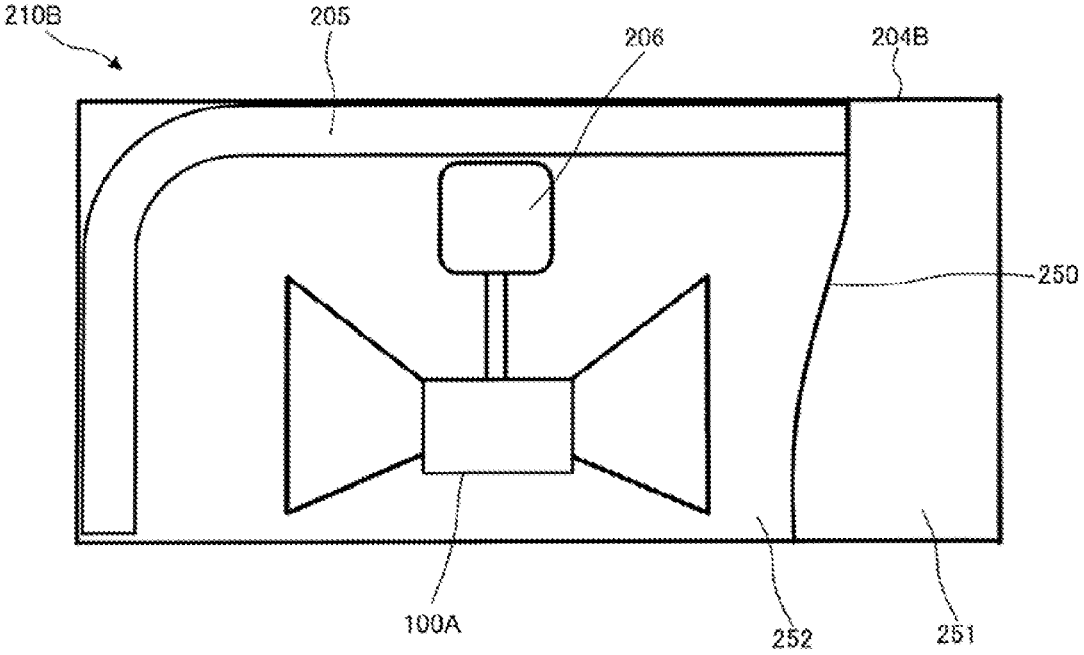
FIG. 15 is a schematic configuration diagram schematically illustrating another example of the configuration of the cooling unit forming a part of the refrigeration cycle apparatus according to Embodiment 6 of the present invention.

FIG. 12 is a circuit configuration diagram schematically illustrating a configuration of a refrigerant circuit of a refrigeration cycle apparatus 200 according to Embodiment 6 of the present invention. FIG. 13 is a schematic perspective view schematically illustrating an example of the configuration of a cooling unit 210 forming a part of the refrigeration cycle apparatus 200 (hereinafter referred to as the cooling unit 210A). FIG. 14 is a cross-sectional view of the cooling unit in FIG. 13 taken along line IV-IV. FIG. 15 is a schematic configuration diagram schematically illustrating another example of the configuration of the cooling unit 210 forming a part of the refrigeration cycle apparatus 200 (hereinafter referred to as the cooling unit 210B). The refrigeration cycle apparatus 200 will be described with reference to FIGS. 12 to 15.

<Configuration of Refrigerant Circuit of Refrigeration Cycle Apparatus 200>

The refrigeration cycle apparatus 200 performs a vapor-compression refrigeration cycle operation, and includes the propeller fan according to any one of Embodiments 1 to 5 in the cooling unit 210 (the cooling unit 210A or 210B). In Embodiment 6, description will be given of an example in which the refrigeration cycle apparatus 200 includes the propeller fan 100A according to Embodiment 1.

The refrigeration cycle apparatus 200 includes the compressor 211, the first heat exchanger 205, an expansion device 213, and a second heat exchanger 221.

Further, in the refrigeration cycle apparatus 200, the compressor 211, the first heat exchanger 205, the expansion device 213, and the second heat exchanger 221 are connected by refrigerant pipes 216 to form a refrigerant circuit.

(Compressor 211)

The compressor 211 compresses refrigerant into high-temperature, high-pressure refrigerant, and discharges the compressed refrigerant. The compressor 211 may be an inverter compressor, for example. For example, a rotary compressor, a scroll compressor, a screw compressor, or a reciprocating compressor may be employed as the compressor 211.

(First Heat Exchanger 205)

The first heat exchanger 205 is used as a condenser (radiator) to condense the refrigerant discharged from the compressor 211 into high-pressure liquid refrigerant. An upstream port of the first heat exchanger 205 is connected to the compressor 211, and a downstream port of the first heat exchanger 205 is connected to the expansion device 213. The first heat exchanger 205 may be a fin-and-tube heat exchanger, for example. The first heat exchanger 205 is equipped with the propeller fan 100A that supplies air to the first heat exchanger 205.

(Expansion Device 213)

The expansion device 213 expands the refrigerant passed through the first heat exchanger 205 to reduce the pressure of the refrigerant. For example, the expansion device 213 may be an electric expansion valve, the opening degree of which is adjustable to be able to adjust the flow rate of the refrigerant. As well as the electric expansion valve, a capillary tube or a mechanical expansion valve employing a diaphragm in a pressure receiving unit may be applied as the expansion device 213. An upstream port of the expansion device 213 is connected to the first heat exchanger 205, and a downstream port of the expansion device 213 is connected to the second heat exchanger 221.

(Second Heat Exchanger 221)

The second heat exchanger 221 is used as an evaporator to evaporate the refrigerant reduced in pressure by the expansion device 213 to convert the refrigerant into gas refrigerant. An upstream port of the second heat exchanger 221 is connected to the expansion device 213, and a downstream port of the second heat exchanger 221 is connected to the compressor 211. The second heat exchanger 221 may be a fin-and-tube heat exchanger, for example. The second heat exchanger 221 is equipped with a fan 222 that supplies air to the second heat exchanger 221, such as a propeller fan.

(Cooling Unit 210)

The compressor 211, the first heat exchanger 205, and the propeller fan 100A are mounted in the cooling unit 210.

(Use-Side Unit 220)

The expansion device 213, the second heat exchanger 221, and the fan 222 are mounted in a use-side unit 220. The expansion device 213 may be mounted not in the use-side unit 220 but in the cooling unit 210.

(Other Components)

A pipe connected to a discharge port of the compressor 211 may be equipped with a flow switching device that switches refrigerant flow passages to allow the first heat exchanger 205 to be used as an evaporator and the second heat exchanger 221 to be used as a condenser.

The flow switching device may be a four-way valve or a combination of two three-way valves or two-way valves, for example.

<Operation of Refrigeration Cycle Apparatus 200>

An operation of the refrigeration cycle apparatus 200 will be described below along a flow of refrigerant.

The compressor 211 is driven to discharge high-temperature, high-pressure, gas-state refrigerant from the compressor 211. The high-temperature, high-pressure gas refrigerant discharged from the compressor 211 flows into the first heat exchanger 205. The first heat exchanger 205 exchanges heat between the high-temperature, high-pressure gas refrigerant flowing in the first heat exchanger 205 and the air supplied by the propeller fan 100A, and the high-temperature, high-pressure gas refrigerant is condensed into high-pressure liquid refrigerant.

The high-pressure liquid refrigerant sent from the first heat exchanger 205 is converted by the expansion device 213 into refrigerant in the low-pressure two-phase state containing gas refrigerant and liquid refrigerant. The refrigerant in the two-phase state flows into the second heat exchanger 221. The second heat exchanger 221 exchanges heat between the refrigerant in the two-phase state flowing in the second heat exchanger 221 and the air supplied by the fan 222, and the liquid refrigerant in the refrigerant in the two-phase state evaporates, turning the refrigerant in the two-phase state into low-pressure gas refrigerant. The low-pressure gas refrigerant sent from the second heat exchanger 221 flows into the compressor 211 to be compressed into high-temperature, high-pressure gas refrigerant, and is discharged again from the compressor 211. Then, this cycle is repeated.

<Cooling Unit 210A>

As illustrated in FIGS. 13 and 14, the cooling unit 210A is intended to be mounted in a vehicle such as a railroad car, and includes a base 201, the propeller fan 100A, a housing 204A, the motor 206, and the first heat exchanger 205.

The base 201 forms a bottom part (a surface for installing the motor 206) and lateral parts of the cooling unit 210A.

The housing 204A is disposed in the base 201 to surround at least the propeller fan 100A, and includes an air outlet 202 and an air inlet 203.

When the z-axis is defined to have a positive side corresponding to the upward side in the normal direction of the base 201 and the x-axis is defined to correspond to a direction perpendicular to the z-axis, the air outlet 202 is formed in a z-axis plane in which a mathematical formula z>0 is satisfied. That is, an opening located in an upper portion of the propeller fan 100A is used as the air outlet 202 that is an air outlet port.

The air inlet 203 is formed to face the x-axis direction of the base 201. That is, an opening at the disposition position of the first heat exchanger 205 is used as the air inlet 203 that is an air inlet port.

The first heat exchanger 205 exchanges heat between the air supplied by the propeller fan 100A and the refrigerant passing through a refrigerant pipe, illustration of which is omitted. The first heat exchanger 205 includes a pair of parts that are each disposed on the vicinity of the corresponding one of pair of parts included in the air inlet 203 in the housing 204A.

The propeller fan 100A is disposed on the z-axis in the housing 204A in such a manner that an airflow is discharged upstream of the air outlet 202 in the positive direction of the z-axis. Specifically, the propeller fan 100A may preferably be disposed directly under the air outlet 202. Further, the propeller fan 100A suctions air into the inside of the base 201 via the air inlet 203, and discharges air to the outside from the inside of the base 201 via the air outlet 202.

The motor 206 supports and drives the propeller fan 100A.

For example, in the cooling unit 210A, an airflow 51 as illustrated in FIG. 14 is obtained as the airflow inside the base 201. When the air blowing direction of the propeller fan 100A is reversed, however, the direction of the airflow inside the base 201 is opposite to the direction of the airflow 51. In this case, the air outlet 202 and the air inlet 203 are also oppositely used.

<Cooling Unit 210B>

As illustrated in FIG. 15, the cooling unit 210B is intended to be used as a heat source-side unit (outdoor unit), and includes components such as the housing 204B forming an exterior of the cooling unit 210B, the propeller fan 100A, the motor 206, and the first heat exchanger 205, and the compressor 211 that is illustrated in FIG. 12. The propeller fan 100A, the motor 206, and the first heat exchanger 205 are each disposed inside the housing 204B The housing 204B is formed in a box shape with air inlets formed in at least two surfaces (a lateral surface and a rear surface, for example) of the housing 204B. Further, the separator 250 is disposed inside the housing 204B to divide an interior of the housing 204B into the air-sending device chamber 252 in which the propeller fan 100A is installed and the mechanical chamber 251 in which components such as the compressor 211 are installed.

The first heat exchanger 205 is formed in an L-shape in a top view of the first heat exchanger 205 in such a manner that the first heat exchanger 205 is positioned to face the lateral surface and the rear surface of the housing 204B corresponding to the air inlets.

A front surface of the housing 204B has an opening that allows air to flow through the front surface of the housing 204B.

Further, the propeller fan 100A is driven to rotate by the motor 206 disposed inside the housing 204B.

As described above, the refrigeration cycle apparatus 200 includes the propeller fan according to any one of Embodiments 1 to 5 in the cooling unit 210. Further, each of the trailing edges 3 of the propeller fan is formed with the recessed portion having the first side formed in a curved shape bent toward the outer circumference of the blade. It is therefore possible to suppress the separation of the airflow at the first side, and thus to reduce the generation of a leakage vortex. Consequently, with the propeller fan according to any one of Embodiments 1 to 5, the refrigeration cycle apparatus 200 is capable of reducing input and noise.

The invention claimed is:

1. A propeller fan, comprising:

a rotary shaft portion configured to rotate around an axial center; and a plurality of blades disposed around an outer circumferential portion of the rotary shaft portion, each blade of the plurality of blades having an inner circumferential end, an outer circumferential end, a leading edge stretching from the inner circumferential end to the outer circumferential end, and a trailing edge stretching from the inner circumferential end to the outer circumferential end, and having at least one recessed portion that opens at the trailing edge of the each blade, and the at least one recessed portion having a first side and a second side that each terminate at the trailing edge, the first side being closer to an inner circumference of the each blade than an outer circumference of the each blade, the first side stretching from the trailing edge toward the leading edge of the each blade and bent toward the outer circumference, the second side being closer to the outer circumference of the each blade than the inner circumference and stretching from the trailing edge toward the leading edge and toward the inner circumference, in the each blade of the plurality of blades, a second projecting portion being formed in a portion of the trailing edge that is radially inward of the at least one recessed portion and that is closer to the inner circumference than is the at least one recessed portion, the second projecting portion projecting downstream, a first side end of the second projecting portion being closest to the outer circumference, a second side end of the second projecting portion being closest to the inner circumference, the first side end coinciding with a side end of the first side of the at least one recessed portion that terminates at the trailing edge, the second projecting portion has a curved shape from the first side end to the second side end and including a maximum projection point which is a point of the second projecting portion projecting most downstream of the each blade, the maximum projecting point being located closer to the second side end than the first side end.

2. The propeller fan of claim 1, wherein, in a top view of the propeller fan, the at least one recessed portion is formed in a substantially triangular shape and including the first side, the second side, and a vertex at which both the first side and the second side terminate at a location that is toward the leading edge.

3. The propeller fan of claim 1, wherein, in a top view of the propeller fan, the at least one recessed portion is formed in a substantially quadrangular shape and including the first side, the second side, and a third side connecting a side end of the first side that is closest to the leading edge and a side end of the second side that is closest to the leading edge.

4. The propeller fan of claim 1, wherein a side connecting the first side end of the second projecting portion and the second side end of the second projecting portion along an outer circumference of the second projecting portion forms a fourth side, a first virtual line being a straight line connecting the first side end and the second side end, a second virtual line being a line perpendicularly extending to the fourth side from a midpoint of the first virtual line, and wherein the maximum projection point of the second projecting portion is located closer to the inner circumference than is an intersection of the fourth side and the second virtual line.

5. A refrigeration cycle apparatus, comprising:

a refrigerant circuit in which a compressor, a first heat exchanger, an expansion device, and a second heat exchanger are connected by pipes; and the propeller fan of claim 1 mounted in a cooling unit together with the first heat exchanger to supply air to the first heat exchanger.

6. A propeller fan, comprising:

a rotary shaft portion configured to rotate around an axial center; and a plurality of blades disposed around an outer circumferential portion of the rotary shaft portion, each blade of the plurality of blades having at least one recessed portion that opens at a trailing edge of the each blade, and the at least one recessed portion having a first side that is closer to an inner circumference of the each blade than an outer circumference of the each blade, the first side stretching from the trailing edge toward a leading edge of the each blade and bent toward the outer circumference, in the each blade of the plurality of blades, a second projecting portion being formed in a portion of the trailing edge that is closer to the inner circumference than is the at least one recessed portion, the second projecting portion projecting downstream, wherein, in a top view of the propeller fan viewed from an upstream side in an axial direction, the first side forms an arc that corresponds to a part of a concentric circle that is concentric with the rotary shaft portion.

7. A propeller fan, comprising:

a rotary shaft portion configured to rotate around an axial center; and a plurality of blades disposed around an outer circumferential portion of the rotary shaft portion, each blade of the plurality of blades having at least one recessed portion that opens at a trailing edge of the each blade, and the at least one recessed portion having a first side that is closer to an inner circumference of the each blade than an outer circumference of the each blade, the first side stretching from the trailing edge toward a leading edge of the each blade and bent toward the outer circumference, in the each blade of the plurality of blades, a second projecting portion being formed in a portion of the trailing edge that is closer to the inner circumference than is the at least one recessed portion, the second projecting portion projecting downstream, wherein, in the each blade of the plurality of blades, the first side has at least one first projecting portion projecting toward the outer circumference of the each blade.

* * * * *